US011390071B2

(12) United States Patent
Lee et al.

(10) Patent No.: US 11,390,071 B2
(45) Date of Patent: Jul. 19, 2022

(54) REAL TIME DROP INFORMATION MEASUREMENT UNIT AND REAL TIME DISCHARGING DROPLET COMPENSATING APPARATUS AND METHOD USING THE SAME

(71) Applicant: SEMES Co. Ltd., Cheonan-si (KR)

(72) Inventors: Donghwa Lee, Cheonan-si (KR); Daigeon Yoon, Seoul (KR); Jaeyong Choi, Seoul (KR); Sanguk Son, Suwon-si (KR); Daesung Kim, Cheonan-si (KR)

(73) Assignee: SEMES Co. Ltd., Cheonan-si (KR)

( * ) Notice: Subject to any disclaimer, the term of this patent is extended or adjusted under 35 U.S.C. 154(b) by 18 days.

(21) Appl. No.: 16/919,993

(22) Filed: Jul. 2, 2020

(65) Prior Publication Data

US 2021/0001624 A1 Jan. 7, 2021

(30) Foreign Application Priority Data

Jul. 5, 2019 (KR) ..... 10-2019-0081480

(51) Int. Cl.
*B41J 2/045* (2006.01)
*B41J 2/125* (2006.01)
(Continued)

(52) U.S. Cl.
CPC ..... *B41J 2/0456* (2013.01); *B41J 2/04506* (2013.01); *B41J 2/04535* (2013.01);
(Continued)

(58) Field of Classification Search
CPC .. B41J 2/0456; B41J 2/04535; B41J 2/04593; B41J 2/04506; B41J 2/04581;
(Continued)

(56) References Cited

U.S. PATENT DOCUMENTS 6,299,275 B1 * 10/2001 Elgee ..... B41J 2/14153 374/166
6,315,383 B1 * 11/2001 Sarmast ..... B41J 2/16579 347/19
(Continued)

FOREIGN PATENT DOCUMENTS

KR 10-2013-0035392 A 4/2013
KR 20130035392 A * 4/2013 ..... B41J 29/393
KR 10-2017-0133799 12/2017

*Primary Examiner* — Yaovi M Ameh
(74) *Attorney, Agent, or Firm* — NSIP Law

(57) ABSTRACT

The present invention relates to real time discharging droplet compensating apparatus and method capable of compensating a discharging degree in real time by feeding-back drop information. To this end, the present invention provides a real time discharging droplet compensating apparatus which is configured by including a discharge control unit controlling the driving of an inkjet head; and a drop measurement unit provided below a substrate to measure drop information of a droplet to be discharged on the substrate and feed-back the measured drop information to the drop measurement unit, wherein the discharge control unit compensates a nozzle waveform of discharging the droplet by using the drop information. Therefore, according to the present invention, the position, size, and volume information of the drop are measured at the same time to be fed-back to the inkjet head unit in real time, thereby acquiring drop information without movement of a separate head unit.

17 Claims, 4 Drawing Sheets

(51) Int. Cl.
*B41J 2/21* (2006.01)
*B41J 2/01* (2006.01)

(52) U.S. Cl.
CPC ..... *B41J 2/04581* (2013.01); *B41J 2/04593* (2013.01); *B41J 2/125* (2013.01); *B41J 2/2142* (2013.01); *B41J 2/01* (2013.01)

(58) Field of Classification Search
CPC . B41J 2/2142; B41J 2/01; B41J 29/393; B41J 2/04536; B41J 2/095; B41J 2/125; H01L 21/02288; H01L 21/4867; H01L 21/6715; H01L 21/67242
See application file for complete search history.

(56) References Cited

U.S. PATENT DOCUMENTS 6,575,550 B1 * 6/2003 Steinfield ..... B41J 2/04506 347/19
2004/0056917 A1 * 3/2004 Su ..... B41J 2/04581 347/19

* cited by examiner

[FIG. 1]
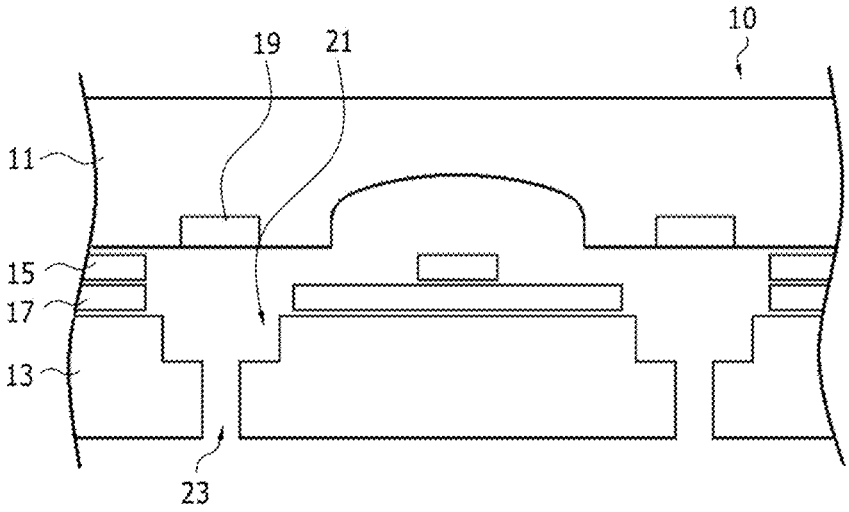
[FIG. 2]
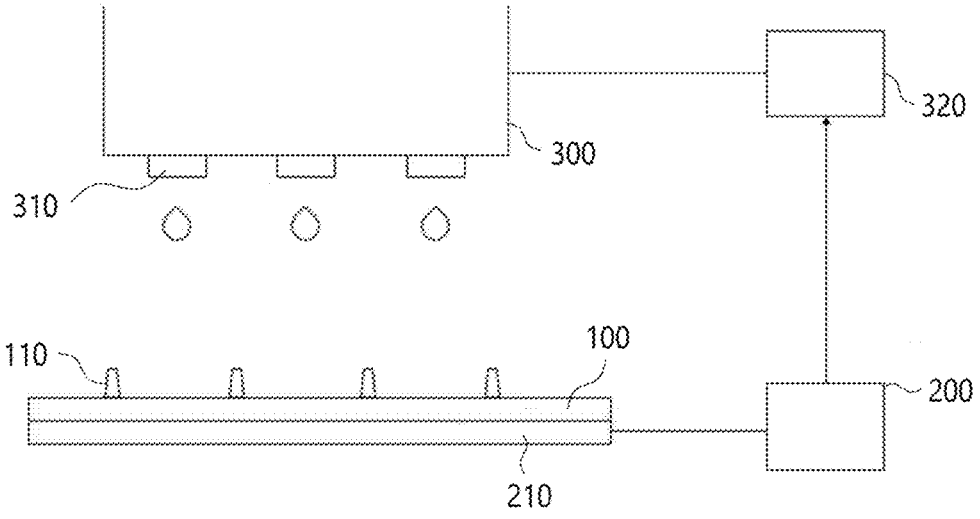

[FIG. 3]
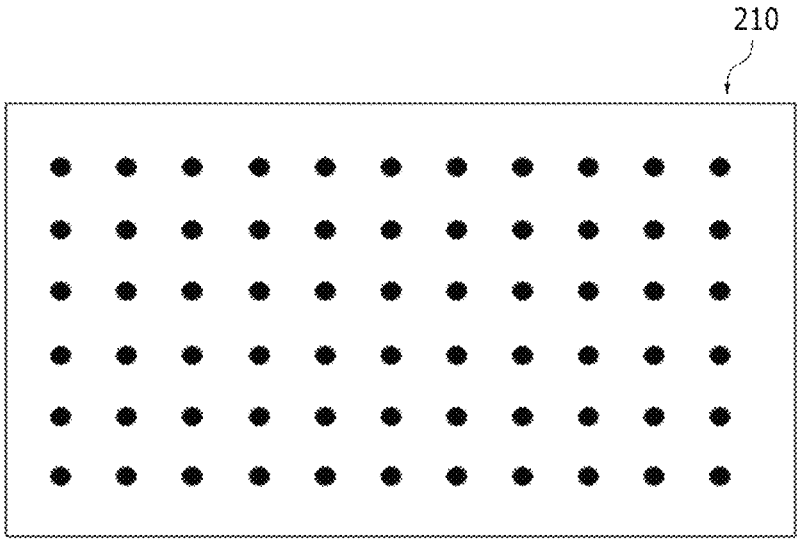
[FIG. 4]
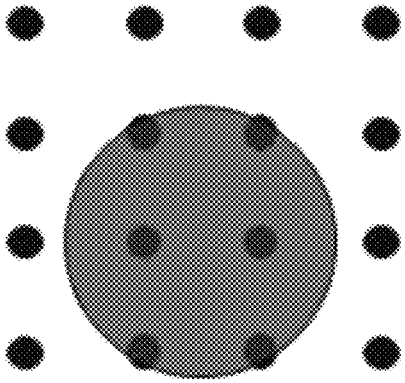

[FIG. 5]
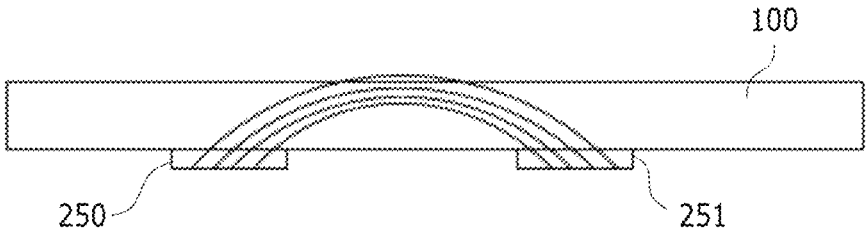
[FIG. 6]
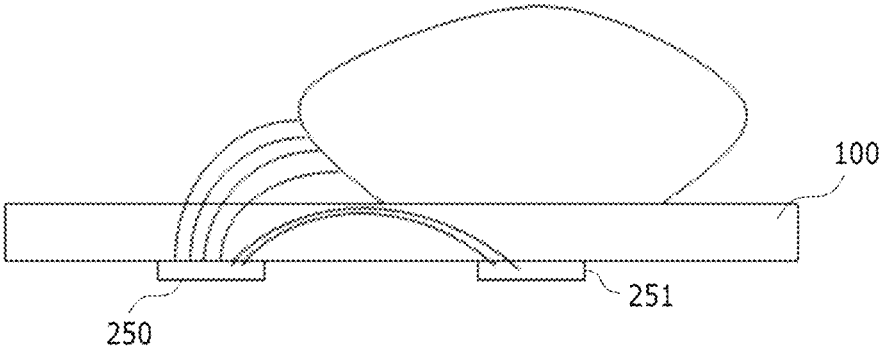

[FIG. 7]
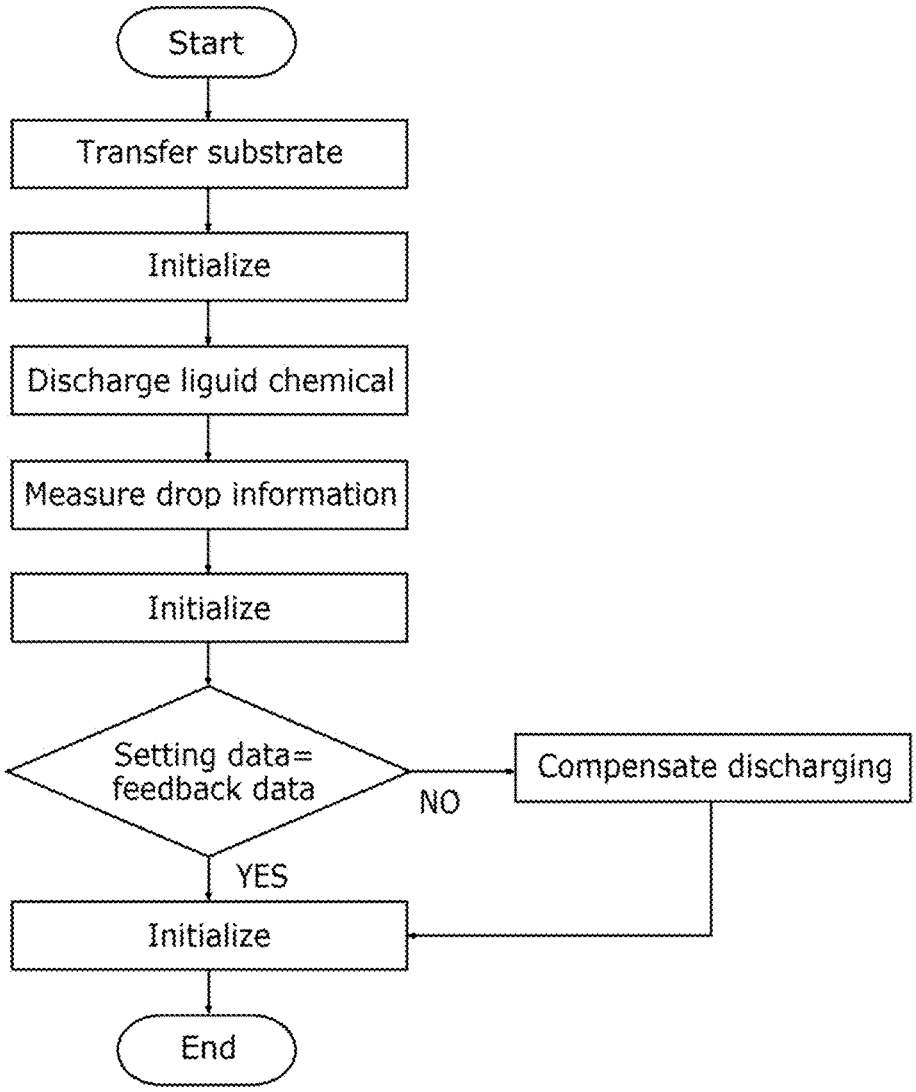

REAL TIME DROP INFORMATION MEASUREMENT UNIT AND REAL TIME DISCHARGING DROPLET COMPENSATING APPARATUS AND METHOD USING THE SAME

CROSS-REFERENCE TO RELATED APPLICATION

This application claims the benefit under 35 U.S.C. 119(a) of Korean Patent Application No. 10-2019-0081480 filed on Jul. 5, 2019, in the Korean Intellectual Property Office, the entire disclosure of which is incorporated herein by reference for all purposes.

TECHNICAL FIELD

The present invention relates to a real time drop information measurement unit and real time discharging droplet compensating apparatus and method using the same, and more particularly, to a real time drop information measurement unit and real time discharging droplet compensating apparatus and method using the same capable of compensating a discharging degree in real time by feeding-back drop information.

BACKGROUND ART

In order to manufacture a display device such as an LCD, inkjet equipment is often used to form an alignment film or discharge droplets when applying UV ink, or applying a color filter on a substrate.

Such inkjet equipment is equipped with a head for discharging droplets, an ink tank for supplying the droplets to the head, and among them, the head for ejecting the droplets through a nozzle needs to eject the droplets with an accurate discharge amount at an accurate position and thus it is necessary to be precisely controlled.

In particular, in recent years, since it is necessary to discharge droplets in a fine pattern, a high level of precision for the discharge amount is required.

According to Korean Patent Publication No. 10-2017-0133799 illustrated in FIG. 1, an inkjet head 10 is constituted by a lower assembly 13 where a nozzle 23 is disposed and an upper assembly 11 connected to a reservoir to supply a droplet to the nozzle.

In addition, the upper assembly 11 is provided with a piezo 19 that determines the discharge amount of the droplet by a magnitude of voltage to be applied.

In such an inkjet device, position and size information of ink drops may be obtained through measurements such as a line scan camera and a glass view camera, and volume information may be obtained through measurement such as drop watcher and laser doppler measurement.

However, since the position, size, and volume information of the ink drops cannot be obtained at the same time, an additional operation for compensating these information is required, and thus, the position, size, and volume information of the ink drops cannot be obtained in real time.

In addition, for the measurement, the inkjet head unit needs to be moved, but there is a problem in that such a measurement method causes an increase in total production time to deteriorate the productivity.

DISCLOSURE

Technical Problem

In order to solve the problems, specifically, an object of the present invention is to compensate a form in which a droplet is discharged from an inkjet head by acquiring drop information to be discharged from a nozzle in real time.

Further, another object of the present invention is to measure position, size, and volume information of drops at the same time to feed-back the measured position, size, and volume information to an inkjet head unit.

Technical Solution

To achieve the objects, the present invention provides a drop measurement unit provided below a substrate to measure drop information of a droplet to be discharged on the substrate from an inkjet head, which is configured by including a sensor module in which a plurality of sensor are disposed, and the drop measurement unit measures a drop position, a drop size, and a drop volume by using information measured by the sensor module.

According to an embodiment, the drop measurement unit may measure a drop size by using the number of sensors which detect the drop.

According to an embodiment, the drop measurement unit may include pressure sensor modules in the form of a matrix and may calculate and map a drop position, a drop size, and a drop volume by using node information of the matrix.

According to an embodiment, the node information may include a coordinate of each node and a detected pressure value.

According to an embodiment, the drop measurement unit may include at least one pair of electrode sensor modules, and calculate and maps a drop position, a drop size, and a drop volume of a droplet having conductivity according to a change in electric field by electrode sensors provided in the electrode sensor module.

According to an embodiment, the electrode sensor modules may include a signal electrode and a ground electrode and electric field is formed to be changed between the signal electrode and the ground electrode by applying a square wave to the signal electrode.

To achieve the objects, the present invention provides a real time discharging droplet compensating apparatus which is configured by including a discharge control unit controlling the driving of an inkjet head; and a drop measurement unit provided below a substrate to measure drop information of a droplet to be discharged on the substrate and feed-back the measured drop information to the drop measurement unit, wherein the discharge control unit compensates a nozzle waveform of discharging the droplet using the drop information.

According to an embodiment, the drop measurement unit may measure a drop size by using the number of sensors which detect the drop.

According to an embodiment, the drop measurement unit may include pressure sensor modules in the form of a matrix and may calculate and map a drop position, a drop size, and a drop volume by using node information of the matrix.

According to an embodiment, the node information may include a coordinate of each node and a detected pressure value.

According to an embodiment, the drop measurement unit may transmit the mapped information to the discharge control unit, and the discharge control unit may compare the mapped information with prestored data to control a discharge amount of the inkjet head by using a result value due to a difference thereof.

According to an embodiment, the drop measurement unit may detect the number of droplets to be dropped per one pixel to the number of drops per pixel to transmit the detected number of droplets to the discharge control unit, and the discharge control unit may compare the number of drops per pixel with a prestored reference number and then controls the inkjet head by using a result value.

According to an embodiment, the drop measurement unit may include at least one pair of electrode sensor modules, and calculate and maps a drop position, a drop size, and a drop volume of a droplet having conductivity according to a change in electric field by electrode sensors provided in the electrode sensor module.

According to an embodiment, the electrode sensor modules may include a signal electrode and a ground electrode and electric field is formed to be changed between the signal electrode and the ground electrode by applying a square wave to the signal electrode.

To achieve the objects, the present invention provides a real time discharging droplet compensating method which performs transferring a substrate to a lower side of an inkjet head; positioning a drop measurement unit below the substrate; discharging a droplet from the inkjet head to the substrate; measuring drop information of the droplet to be discharged to the substrate by the drop measurement unit; and feeding-back a signal capable of controlling a size of the droplet to be discharged from the inkjet head by using the drop information to a discharge control unit by the drop measurement unit.

According to an embodiment, the drop measurement unit may include pressure sensors in the form of a matrix and may calculate a drop position, a drop size, and a drop volume by using node information of the matrix.

According to an embodiment, the node information includes a coordinate of each node and a detected pressure value.

According to an embodiment, the electrode sensor modules include a signal electrode and a ground electrode and electric field is formed to be changed between the signal electrode and the ground electrode by applying a square wave to the signal electrode.

According to an embodiment, The real time discharging droplet compensating method further comprising: receiving, by the discharge control unit, the feed-back from the drop measurement unit and comparing, by the discharge control unit, the setting data with the feed-back to determine whether the discharge compensation is performed.

Advantageous Effects

According to the present invention, it is possible to acquire drop information without moving a separate head unit by measuring the position, size, and volume information of the drop at the same time to feed-back the measured position, size, and volume information to the inkjet head unit in real time.

Further, it is possible to control the size of a droplet to be discharged from the inkjet head in real time by acquiring the drop information to be discharged from the nozzle.

DESCRIPTION OF DRAWINGS

FIG. 1 is a structural diagram illustrating a structure of an inkjet head according to the related art;

FIG. 2 is a configuration diagram illustrating a configuration of a real time discharging droplet compensating apparatus according to the present invention;

FIG. 3 is a configuration diagram illustrating a configuration of a pressure sensor module in FIG. 2;

FIG. 4 is an exemplary diagram for describing a calculation method of a drop size in FIG. 3;

FIGS. 5 and 6 are exemplary diagrams illustrating another embodiment of the real time discharging droplet compensating apparatus according to the present invention; and FIG. 7 is a flowchart illustrating a real time discharging droplet compensating method according to the present invention.

MODES OF THE INVENTION

Configurations and functions of embodiments of the present invention will be described in detail with reference to the accompanying drawings.

Referring to FIG. 2, a real time discharging droplet compensating apparatus according to the present invention is configured to include a drop measurement unit 200 and a discharge control unit 320.

In the embodiment, the drop measurement unit 200 includes a pressure sensor module 210. The pressure sensor module 210 includes matrix-based pressure sensors, and is provided below a substrate to acquire drop information of a droplet to be discharged onto the substrate.

In the embodiment, the substrate 100 may be used with various substrates, such as a transparent substrate for manufacturing a liquid crystal display and the like, or a substrate for manufacturing an organic EL display and the like. For example, substrates such as polyethylene naphthalate (PEN), polyethylene terephthalate (PET), polyether sulfone (PES), polyimide (PI), and glass may be used.

The substrate is provided on the pressure sensor module 210, and a liquid chemical is discharged onto the substrate in a predetermined shape by an inkjet device.

A pixel partition wall 110 constituting a pixel is formed on the substrate 100 to realize each color of RGB.

Referring to FIG. 3, the pressure sensor module 210 is provided with a pressure sensor at each node in a matrix form, and the drop measurement unit 200 calculates whether a droplet has been dropped on the substrate, a drop size, and a drop volume based on the node information by the pressure sensor. The node information includes a coordinate of each node, a detected pressure value, etc.

Specifically, when an interval of the pressure sensor in the pressure sensor module 210 is 5 μm, if the droplet discharged from the inkjet head is detected by six pressure sensors as illustrated in FIG. 4, the drop position may be determined to a position of an average of coordinate values of the six nodes or a node closest to the average. Further, a drop size S may be calculated to $5\times10=50\ \mu m^2$.

In addition, if pressure values measured by the six pressure sensors are P1, P2, P3, P4, P5, and P6, respectively, the drop measurement unit 200 calculates an average of the pressure values by the six pressure sensors to PA=(P1+P2+P3+P4+P5+P6)/6.

If the mass of the liquid chemical is m, the density is p, and the volume is V, $$P_A\times5=mg=\rho Vg,$$

the drop volume may be calculated to $V=(P_A\times S)/\rho g$.

The drop measurement unit 200 performs mapping that displays the drop information which has been calculated above, that is, the drop position, the drop size, and the drop volume in response to a corresponding position on the matrix. These drop information may be numerically stored during mapping.

Such measurement performed by the drop measurement unit needs to be first performed based on pressure by the substrate. For example, before the discharging of the liquid chemical, a pressure value by the substrate is first stored as an initial pressure value, and the drop information may be calculated by using a value obtained by subtracting the stored initial pressure value from the pressure value by the pressure sensor module detected after the discharging of the liquid chemical.

The drop measurement unit 200 performs a mapping operation and then transmits mapping information to the discharge control unit 320. The discharge control unit 320 compares setting data prestored in a storage unit with the mapping information transmitted from the drop measurement unit to calculate a result value by a difference thereof and controls the inkjet head by using the result value.

Specifically, the storage unit stores the setting data, such as a size of a droplet to be discharged, a discharge rate, the number of droplets to be discharged per one pixel, a discharge position, etc. In addition, when the discharge control unit 320 starts to operate the inkjet device, the discharge control unit 320 drives a piezoelectric element based on the setting data stored in the storage unit to perform the discharging of the liquid chemical.

While the operation of the inkjet device is performed, the drop measurement unit 200 calculates drop information of the droplet to be discharged and generates mapping information to feed-back the generated mapping information to the discharge control unit 320 again, and the discharge control unit calculates a difference obtained by subtracting the drop position and the drop size fed-back from the discharge control unit from the drop position and the drop size by the setting data.

For example, when the result value obtained by subtracting the fed-back drop size from the drop size by the setting data is negative, the discharge control unit weakens the driving of the piezoelectric element to control the discharge size to be small. At this time, the driving of the piezoelectric element is adjusted by the size of the result value to adjust the nozzle waveform and compensate the discharge amount of the chemical liquid precisely.

Even in the case of the drop position, the discharge control unit calculates a difference vector by subtracting a coordinate of the fed-back drop position from a coordinate of the drop position by the setting data in the same manner as the drop size and controls a motion of the inkjet head based on the difference vector to compensate the discharge position precisely.

The drop measurement unit 200 may calculate a drop position, a drop size, a drop volume, and the number of drops per pixel by using the pressure sensor module.

The number of drops per pixel refers to the number of droplets to be dropped in one pixel, and the drop measurement unit measures the number of times of applying the pressure to the pressure sensor to detect the number of drops per pixel and transmits the number of drops per pixel to the discharge control unit.

The discharge control unit compares the number of drops per pixel fed-back from the discharge control unit with the number of droplets to be discharged per one pixel stored in the setting data to compensate a difference thereof when the number of drops per pixel is different from the number of droplets.

Next, another embodiment of the drop measurement unit will be described.

Referring to FIG. 5, the drop measurement unit may include other sensor modules, and in the embodiment, the drop measurement unit includes at least one pair of electrode sensor modules 250 and 251.

The pressure sensor modules 250 and 251 are disposed in a matrix form and provided below a substrate to acquire drop information of a droplet to be discharged onto the substrate.

Specifically, the electrode sensor modules include a signal electrode 250 and a ground electrode 251 and the drop measurement unit 200 applies a square wave to the signal electrode 250. Then, an electric field is formed to be changed between the signal electrode 250 and the ground electrode 251 via the substrate 100, and a displacement current is formed.

At this time, when the droplet having conductivity is dropped on the substrate from the inkjet head, as illustrated in FIG. 6, the electric field is changed and a capacitance and a displacement current between the two electrodes are varied, so that the drop measurement unit 200 may determine whether the droplet has been dropped at the corresponding position.

Further, the drop size is calculated by calculating how many of the electrodes the drop is detected in the electrode sensors arranged in a matrix form, and the drop volume may also be calculated by the method described above. In order to calculate the drop size, it is preferable to calculate how many adjacent electrodes the drop has been detected, and to determine a separate drop when the drop is detected on electrodes which are not adjacent but separated from each other.

Next, a real time discharging droplet compensating method according to the present invention will be described with reference to FIG. 7.

When a substrate is transferred, the substrate is provided on a pressure sensor module or an electrode sensor module, and when the substrate is provided in place, a drop measurement unit starts initialization. That is, pressure information by the substrate itself is stored in the drop measurement unit, and the pressure information of the substrate itself may be set to zero.

When the initialization step ends, the drop measurement unit transmits an initialization end signal to the discharge control unit, and when the discharge control unit receives the initialization end signal, the discharge control unit reads setting data stored in a storage unit to drive an inkjet head based on the setting data. The setting data may include data, such as the size of a droplet, a discharging rate, the number of droplets to be discharged per pixel, and a discharging position.

When a liquid chemical is discharged from the inkjet head based on the setting data, the drop measurement unit measures drop information of the droplet dropped on the substrate. The drop information may include information on a drop position, a drop size, a drop volume, the number of drops per pixel, etc.

The drop measurement unit generates mapping information of a position corresponding to the matrix based on the measured drop information to feed-back the generated mapping information to the discharge control unit.

The discharge control unit receives the feed-back from the drop measurement unit and compares the setting data with the feed-back data to determine whether the discharge compensation is performed. At this time, a size of the compensation is determined together by a difference value between the setting data and the feed-back data.

As described above, in the embodiment, since the discharge amount of the liquid chemical, the discharging method, or the like is compensated in real time by the discharge control unit, precise control is enabled without moving the inkjet head.

As described above, the present invention has been described with reference to the exemplary embodiments. However, it will be appreciated by those skilled in the art that various modifications and changes of the present invention can be made without departing from the spirit and the scope of the present invention which are disclosed in the appended claims.

EXPLANATION OF REFERENCE NUMERALS AND SYMBOLS

100: Substrate
200: Drop measurement unit
210: Pressure sensor module
300: Inkjet head
320: Discharge control unit

The invention claimed is:

1. A drop measurement unit provided below a substrate to measure drop information of a droplet to be discharged on the substrate from an inkjet head, the drop measurement unit comprising:

a sensor module in which a plurality of sensor are disposed, and the drop measurement unit that measures a drop position, a drop size, and a drop volume by using information measured by the sensor module, wherein the drop measurement unit includes pressure sensor modules in a form of a matrix, and calculates and maps the drop position, the drop size, and the drop volume by using node information of the matrix.

2. The drop measurement unit of claim 1, wherein the drop measurement unit measures a drop size by using the plurality of sensors.

3. The drop measurement unit of claim 1, wherein the node information includes a coordinate of each node and a detected pressure value.

4. The drop measurement unit of claim 1, wherein the drop measurement unit includes at least one pair of electrode sensor modules, and calculates and maps a drop position, a drop size, and a drop volume of a droplet having conductivity according to a change in electric field by electrode sensors provided in the electrode sensor module.

5. The drop measurement unit of claim 4, wherein the electrode sensor modules include a signal electrode and a ground electrode and electric field is formed to be changed between the signal electrode and the ground electrode by applying a square wave to the signal electrode.

6. A real time discharging droplet compensating apparatus comprising:

a discharge control unit controlling the driving of an inkjet head; and a drop measurement unit provided below a substrate to measure drop information of a droplet to be discharged on the substrate and feed-back the measured drop information to the discharge control unit, wherein the discharge control unit compensates a nozzle waveform of discharging the droplet by using the drop information, wherein the drop measurement unit includes pressure sensor modules in a form of a matrix in which a plurality of sensors are disposed, and calculates and maps a drop position, a drop size, and a drop volume by using node information of the matrix.

7. The real time discharging droplet compensating apparatus of claim 6, wherein the drop measurement unit measures a drop size by using the plurality of sensors.

8. The real time discharging droplet compensating apparatus of claim 6, wherein the node information includes a coordinate of each node and a detected pressure value.

9. The real time discharging droplet compensating apparatus of claim 6, wherein the drop measurement unit transmits the mapped information to the discharge control unit, and the discharge control unit compares the mapped information with prestored data to control a discharge amount of the inkjet head by using a result value due to a difference thereof.

10. The real time discharging droplet compensating apparatus of claim 6, wherein the drop measurement unit detects the number of droplets to be dropped per one pixel to the number of drops per pixel to transmit the detected number of droplets to the discharge control unit, and the discharge control unit compares the number of drops per pixel with a prestored reference number and then controls the inkjet head by using a result value.

11. The real time discharging droplet compensating apparatus of claim 6, wherein the drop measurement unit includes at least one pair of electrode sensor modules, and calculates and maps a drop position, a drop size, and a drop volume of a droplet having conductivity according to a change in electric field by electrode sensors provided in the electrode sensor module.

12. The real time discharging droplet compensating apparatus of claim 11, wherein the electrode sensor modules include a signal electrode and a ground electrode and an electric field is formed to be changed between the signal electrode and the ground electrode by applying a square wave to the signal electrode.

13. A real time discharging droplet compensating method comprising:

transferring a substrate to a lower side of an inkjet head;

positioning a drop measurement unit below the substrate;

discharging a droplet from the inkjet head to the substrate;

measuring drop information of the droplet to be discharged to the substrate by the drop measurement unit; and feeding-back a signal capable of controlling a size of the droplet to be discharged from the inkjet head by using the drop information to a discharge control unit by the drop measurement unit, wherein the drop measurement unit includes pressure sensors in a form of a matrix and calculates a drop position, a drop size, and a drop volume by using node information of the matrix.

14. The real time discharging droplet compensating method of claim 13, wherein the node information includes a coordinate of each node and a detected pressure value.

15. The real time discharging droplet compensating method of claim 13, wherein the electrode sensor modules include a signal electrode and a ground electrode and electric field is formed to be changed between the signal electrode and the ground electrode by applying a square wave to the signal electrode.

16. The real time discharging droplet compensating method of claim 13, further comprising:

receiving, by the discharge control unit, the feed-back from the drop measurement unit and comparing, by the discharge control unit, the setting data with the feed-back to determine whether the discharge compensation is performed.

17. The real time discharging droplet compensating method of claim 16, wherein the setting data includes a size of a droplet to be discharged, a discharge rate, a number of droplets to be discharged per one pixel, a discharge position.

* * * * *